US005095301A

United States Patent [19]

Guttag et al.

[11] Patent Number: 5,095,301

[45] Date of Patent: Mar. 10, 1992

[54] GRAPHICS PROCESSING APPARATUS HAVING COLOR EXPAND OPERATION FOR DRAWING COLOR GRAPHICS FROM MONOCHROME DATA

[75] Inventors: Karl M. Guttag, Houston; Michael D. Asal, Sugarland, both of Tex.; Mark F. Novak, Colorado Springs, Colo., Thomas Preston, Thurleigh, United Kingdom

[73] Assignee: Texas Instruments Incorporated, Dallas, Tex.

[21] Appl. No.: 506,506

[22] Filed: Apr. 6, 1990

Related U.S. Application Data

[63] Continuation of Ser. No. 361,747, Jun. 1, 1989, abandoned, which is a continuation of Ser. No. 178,798, Mar. 31, 1988, abandoned, which is a continuation of Ser. No. 795,383, Nov. 6, 1985, abandoned.

[51] Int. Cl.[5] ..... G09G 1/28

[52] U.S. Cl. ..... 340/703; 340/701

[58] Field of Search ..... 340/701, 703, 725, 723, 340/793; 358/81, 82

[56] References Cited

U.S. PATENT DOCUMENTS

| | | | |
|---|---|---|---|
| 3,911,418 | 10/1975 | Takeda | 340/703 |
| 4,243,984 | 1/1981 | Ackley et al. | 340/703 |
| 4,467,322 | 8/1984 | Bell et al. | 340/703 |
| 4,475,104 | 10/1984 | Shen | 340/703 |
| 4,509,043 | 4/1985 | Mossaides | 340/703 |
| 4,516,118 | 5/1985 | Wahlquist | 340/703 |
| 4,779,210 | 10/1988 | Katsura et al. | 364/521 |

OTHER PUBLICATIONS

Yonezawa et al., *Electronic Design*, "CRT chip controls bit-mapped graphics and alphanumerics", Jun. 14, 1984, pp. 247-252, 254 and 256.

Guttag and Hayn, "Video Display Processor Simulates Three Dimensions", *Electronics*, Nov. 20, 1980, pp. 123-126.

Guttag and Macourek, "Video Display Processor", *IEEE Trans. on Consumer Electronics*, Feb. 1981, vol. CE-27, pp. 27-34.

"Hitachi HD63484 Microcomputer LSI Advanced CRT Controller", pp. A0, A12, A29, Bi, B63, B72, B118, B120-121, B140-158, and B171-172, Revision 2.0 7/15/84.

*Primary Examiner*—Jeffery A. Brier

*Attorney, Agent, or Firm*—Melvin Sharp; James T. Comfort; Lawrence J. Bassuk

[57] ABSTRACT

A monochrome image becomes expanded into a color image for storage in a bit mapped color display memory. The color expand operation substitutes color data of one of two designated colors for the "1" or "0" monochrome data of a stored monochrome image. The first color code is substituted for all pixels of the monochrome image represented by a "1" and the second color code is substituted for all pixels of the monochrome image represented by a "0". This color expanded image is then stored in the color display memory which controls the color picture shown to the user. This technique permits storage of commonly used images such as alphanumeric characters of various fonts or icons in a compressed form with one bit per pixel. These images are formed in color using the color expand operation at the time of drawing into the color display memory. Otherwise these images would need to be stored in multiple bit per pixel color form for all desired colors requiring considerable memory for redundant data. This color expanded image may then be combined with the color image stored in a selected part of the display memory and the combined image stored in that selected part of the display memory. Thus monochrome images may be expanded into color images and then combined with color images already in the display in a single operation.

50 Claims, 9 Drawing Sheets

GRAPHICS PROCESSING APPARATUS HAVING COLOR EXPAND OPERATION FOR DRAWING COLOR GRAPHICS FROM MONOCHROME DATA

This application is a continuation of application Ser. No. 07/361,747 filed June 1, 1989, now abandoned, which was a continuation of application Ser. No. 07/178,798 filed Mar. 31, 1988, now abandoned, which was a continuation of application Ser. No. 06/795,383 filed Nov. 6, 1985, now abandoned.

BACKGROUND OF THE INVENTION

The present invention relates to the field of computer graphics. In particular, this invention relates to the field of bit mapped computer graphics in which the computer memory stores data for each individual picture element or pixel of the display at memory locations that correspond to the location of that pixel on the display. The field of bit mapped computer graphics has benefited greatly from the lowered cost per bit of dynamic random access memory (DRAM). The lowered cost per bit of memory enables larger and more complex displays to be formed in the bit mapped mode.

The reduction in the cost per bit of memory and the consequent increase in the capacity of bit mapped computer graphics has led to the need for processing devices which can advantageously use the bit mapped memory in computer graphics applications. In particular, a type of device has arisen which includes the capacity to draw simple figures, such as lines and circles, under the control of the main processor of the computer. In addition, some devices of this type include a limited capacity for bit block transfer (known as BITBLT or raster operation) which involves the transfer of image data from one portion of memory to another, together with logical or arithmetic combinations of that data with the data at the destination location within the memory.

These bit-map controllers with hard wired functions for drawings lines and performing other basic graphics operations represent one approach to meeting the demanding performance requirements of bit maps displays. The built-in algorithms for performing some of the most frequently used graphics operations provides a way of improving overall system performance. However, a useful graphics system often requires many functions in addition to those few which are implemented in such a hard wired controller. These additional required functions must be implemented in software by the primary processor of the computer. Typically these hard wired bit-map controllers permit the processor only limited access to the bit-map memory, thereby limiting the degree to which software can augment the fixed set of functional capacities of the hard wired controller. Accordingly, it would be highly useful to be able to provide a more flexible solution to the problem of controlling the contents of the bit mapped memory, either by providing a more powerful graphics controller or by providing better access to this memory by the system processor, or both.

SUMMARY OF THE INVENTION

The provision of bit mapped graphics presents a special problem for widely used symbols such as alphanumeric characters and icons. It is desirable to be able to provide such widely used symbols with any of the colors permitted by the graphics system in order to provide the desired contrast or complement with the other matter to be displayed. This presents a problem when the color of each pixel is represented by more than a single bit. In prior systems either the bit mapped data for these widely used symbols must be stored in memory in each possible color or these symbols must be limited to only a few colors. Using bit mapped graphics for symbols such as alphanumeric characters is advantageous because this permits the implementation of more than one type font. If each of several type fonts must be stored in a plurality of possible colors the memory requirements would be prohibitive. On the other hand, limiting the number of possible colors for such symbols would reduce the flexibility which is inherent in the bit mapped format. Thus it would be desirable to be able to store such widely used characters in a compressed format while maintaining the capability to display these symbols in any color supported by the graphics system.

The present invention seeks to solve this problem by permitting these widely used symbols to be stored in a monochrome format. In a monochrome format each pixel is represented by a single bit, a "1" indicating the foreground and a "0" indicating the background. This storage format minimizes the amount of memory necessary to store the bit map data for these symbols. When it is desired to display such symbols, the monochrome image is expanded into a color image for storage in the bit mapped color display memory.

The color expand operation substitutes color data of one of two designated colors for the "1" or "0" monochrome data of a stored monochrome image. The first color code is substituted for all pixels of the monochrome image represented by a "1" and the second color code is substituted for all pixels of the monochrome image represented by a "0". This color expanded image is then stored in the color display memory which controls the color picture shown to the user. Once the monochrome image has been expanded into a color image in this manner, it may be processed in the same manner as any other bit mapped color image. Thus the expanded color image may be stored in the bit mapped memory for display or it may be combined with other color image data in any permitted raster operation.

BRIEF DESCRIPTION OF THE DRAWINGS

These and other objects of the present invention will be readily understood from the following description, taken in conjunction with the drawings in which.

DETAILED DESCRIPTION OF THE PREFERRED EMBODIMENT

Figure 1:
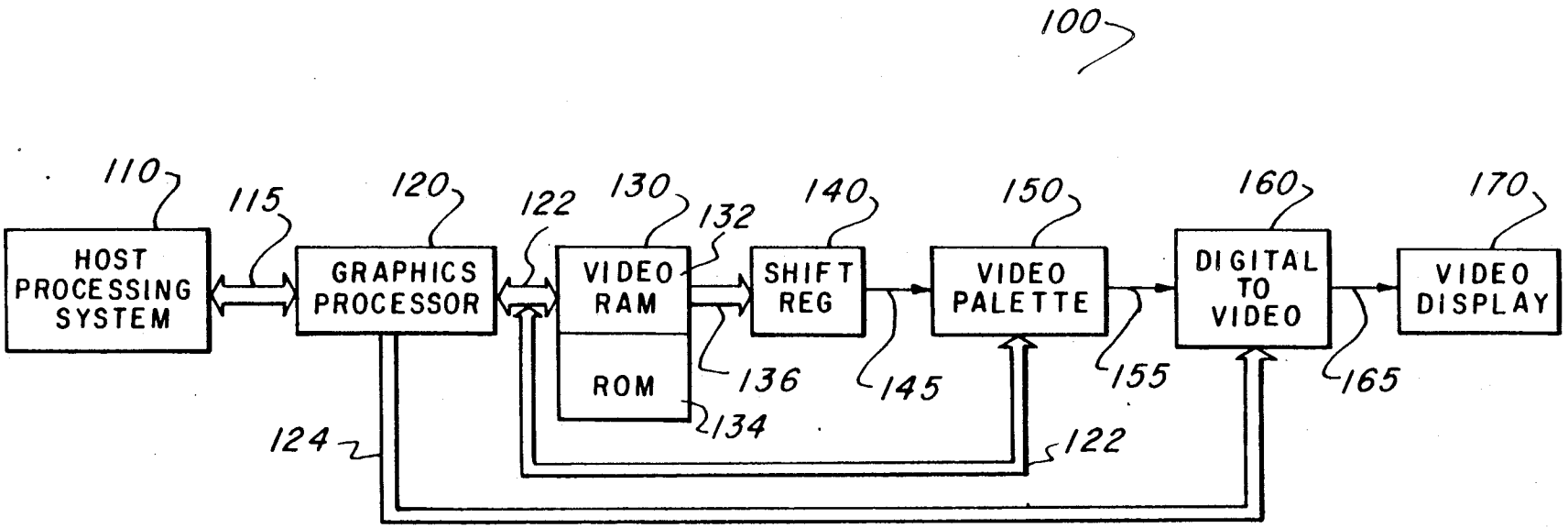
FIG. 1 illustrates a block diagram of a computer with graphics capability constructed in accordance with the principles of the present invention.

FIG. 1 illustrates a block diagram of graphics computer system 100 which is constructed in accordance with the principles of the present invention. Graphics computer system 100 includes host processing system 110, graphics processor 120, memory 130, shift register 140, video palette 150, digital to video converter 160 and video display 170.

Host processing system 110 provides the major computational capacity for the graphics computer system 100. Host processing system 110 preferably includes at least one microprocessor, read only memory, random access memory and assorted peripheral devices for forming a complete computer system. Host processing system 110 preferably also includes some form of input device, such as a keyboard or a mouse, and some form of long term storage device such as a disk drive. The details of the construction of host processing system 110 are conventional in nature and known in the art, therefore the present application will not further detail this element. The essential feature of host processing system 110, as far as the present invention is concerned, is that host processing system 110 determines the content of the visual display to be presented to the user.

Graphics processor 120 provides the major data manipulation in accordance with the present invention to generate the particular video display presented to the user. Graphics processor 120 is bidirectionally coupled to host processing system 110 via host bus 115. In accordance with the present invention, graphics processor 120 operates as an independent data processor from host processing system 110, however, it is expected that graphics processor 120 is responsive to requests from host processing system 110 via host bus 115. Graphics processor 120 further communicates with memory 130, and video palette 150 via video memory bus 122. Graphics processor 120 controls the data stored within video RAM 132 via video memory bus 122. In addition, graphics processor 120 may be controlled by programs stored in either video RAM 132 or read only memory 134. Read only memory 134 may additionally include various types of graphic image data, such as alphanumeric characters in one or more font styles and frequently used icons. In addition, graphics processor 122 controls the data stored within video palette 150. This feature will be further disclosed below. Lastly, graphics processor 120 controls digital to video converter 160 via video control bus 124. Graphics processor 120 may control the line length and the number of lines per frame of the video image presented to the user by control of digital to video converter 160 via video control bus 124.

Video memory 130 includes video RAM 132 which is bidirectionally coupled to graphics processor 120 via video memory bus 122 and read only memory 134. As previously stated, video RAM 132 includes the bit mapped graphics data which controls the video image presented to the user. This video data may be manipulated by graphics processor 120 via video memory bus 122. In addition, the video data corresponding to the current display screen is output from video RAM 132 via video output bus 136. The data from video output bus 136 corresponds to the picture element to be presented to the user. In the preferred embodiment video RAM 132 is formed of a plurality of TMS4161 64K dynamic random access integrated circuits available from Texas Instruments Corporation, the assignee of the present application. The TMS4161 integrated circuit includes dual ports, enabling display refresh and display update to occur without interference.

Shift register 140 receives the video data from video RAM 130 and assembles it into a display bit stream. In accordance with the typical arrangement of video random access memory 132, this memory consists of a bank of several separate random access memory integrated circuits. The output of each of these integrated circuits is typically only a single bit wide. Therefore, it is necessary to assemble data from a plurality of these circuits in order to obtain a sufficiently high data output rate to specify the image to be presented to the user. Shift register 140 is loaded in parallel from video output bus 136. This data is output in series on line 145. Thus shift register 140 assembles a display bit stream which provides video data at a rate high enough to specify the individual dots within the raster scanned video display.

Video palette 150 receives the high speed video data from shift register 140 via bus 145. Video palette 150 also receives data from graphics processor 120 via video memory bus 122. Video palette 150 converts the data received on bus 145 into a video level output on bus 155. This conversion is achieved by means of a lookup table which is specified by graphics processor 120 via video memory bus 122. The output of video palette 150 may comprise color hue and saturation for each picture element or may comprise red, green and blue primary color levels for each pixel. The table of conversion from the code stored within video memory 132 and the digital levels output via bus 155 is controlled from graphics processor 120 via video memory bus 122.

Digital to video converter 160 receives the digital video information from video palette 150 via bus 155. Digital to video converter 160 is controlled by graphics processor 120 via video control bus 124. Digital to video converter 160 serves to convert the digital output of video palette 150 into the desired analog levels for application to video display 170 via video output 165. Digital to video converter 160 is controlled for a specification of the number of pixels per horizontal line and the number of lines per frame, for example, by graphics processor 120 via video controller bus 124. Data within graphics processor 120 controls the generation of the synchronization and blanking signals and the retrace signals by digital to video converter 160. These portions of the video signal are not specified by the data stored within video memory 132, but rather form the control signals necessary for specification of the desired video output.

Lastly, video display 170 receives the video output from digital to video converter 160 via video output line 165. Video display 170 generates the specified video image for viewing by the operator of graphics computer system 100. It should be noted that video palette 150, digital to video converter 160 and video display 170 may operate in accordance to two major video techniques. In the first, the video data is specified in terms of color hue and saturation for each individual pixel. In the other technique, the individual primary color levels of red, blue and green are specified for each individual pixel. Upon determination of the design choice of which of these major techniques to be employed, video palette 150, digital to converter 160 and video display 170 must be constructed to be compatible to this technique. However, the principles of the present invention in regard to the operation of graphics processor 120 are unchanged regardless of the particular design choice of video technique.

Figure 2:
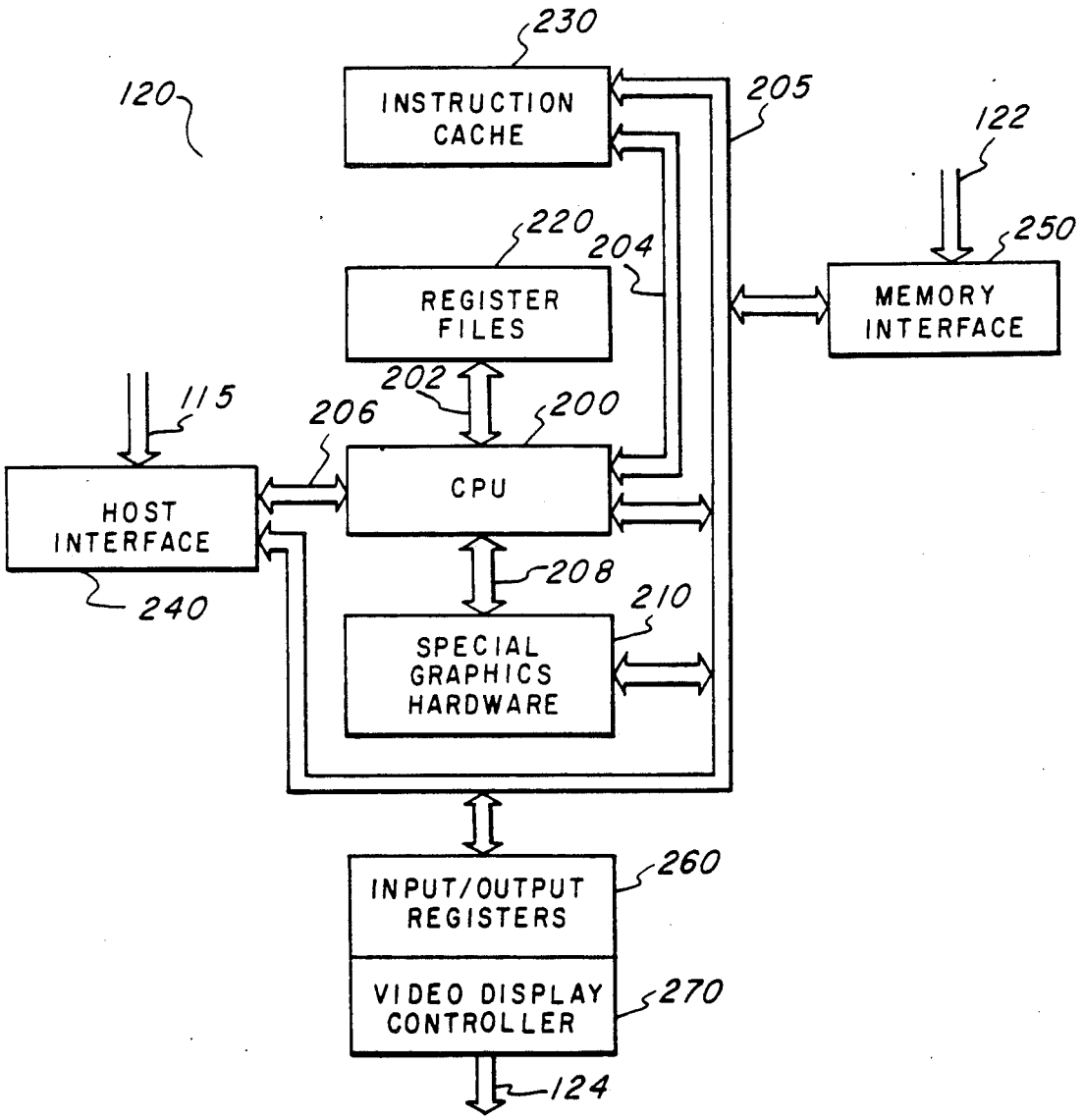
FIG. 2 illustrates the block diagram of a preferred embodiment of the graphics processing circuit of the present invention.

FIG. 2 illustrates graphics processor 120 in further detail. Graphics processor 120 includes central processing unit 200, special graphics hardware 210, register files 220, instruction cache 230, host interface 240, memory interface 250, input/output registers 260 and video display controller 270.

The heart of graphics processor 120 is central processing unit 200. Central processing unit 200 includes the capacity to do general purpose data processing including a number of arithmetic and logic operations normally included in a general purpose central processing unit. In addition, central processing unit 200 controls a number of special purpose graphics instructions, either alone or in conjunction with special graphics hardware 210.

Graphics processor 120 includes a major bus 205 which is connected to most parts of graphics processor 120 including the central processing unit 200. Central processing unit 200 is bidirectionally coupled to a set of register files, including a number of data registers, via bidirectional register bus 202. Register files 220 serve as the depository of the immediately accessible data used by central processing unit 200. As will be further detailed below, register files 220 includes in addition to general purpose registers which may be employed by central processing unit 200, a number of data registers which are employed to store implied operands for graphics instructions.

Central processing unit 200 is connected to instruction cache 230 via instruction cache bus 204. Instruction cache 230 is further coupled to general bus 205 and may be loaded with instruction words from the video memory 130 via video memory bus 122 and memory interface 250. The purpose of instruction cache 230 is to speed up the execution of certain functions of central processing unit 200. A repetitive function or function that is used often within a particular portion of the program executed by central processing unit 200 may be stored within instruction cache 230. Access to instruction cache 230 via instruction cache bus 204 is much faster than access to video memory 130. Thus, the program executed by central processing unit 200 may be speeded up by preliminarily loading the repeated or often used sequences of instructions within instruction cache 230. Then these instructions may be executed more rapidly because they may be fetched more rapidly. Instruction cache 230 need not always contain the same sets of instructions, but may be loaded with a particular set of instructions which will be often used within a particular portion of the program executed by central processing unit 200.

Host interface 240 is coupled to central processing unit 200 via host interface bus 206. Host interface 240 is further connected to the host processing system 110 via host system bus 115. Host interface 240 serves to control the communication between the host processing system 110 and the graphics processor 120. Host interface 240 controls the timing of data transfer between host processing system 110 and graphics processor 120. In this regard, host interface 240 enables either host processing system 110 to interrupt graphics processor 120 or vice versa enabling graphics processor 120 to interrupt host processing system 110. In addition, host interface 240 is coupled to the major bus 205 enabling the host processing system 110 to control directly the data stored within memory 130. Typically host interface 240 would communicate graphics requests from host processing system 110 to graphics processor 120, enabling the host system to specify the type of display to be generated by video display 170 and causing graphics processor 120 to perform a desired graphic function.

Central processing unit 200 is coupled to special graphics hardware 210 via graphics hardware bus 208. Special graphics hardware 210 is further connected to major bus 205. Special graphics hardware 210 operates in conjunction with central processing unit 200 to perform special graphic processing operations. Central processing unit 200, in addition to its function of providing general purpose data processing, controls the application of the special graphics hardware 210 in order to perform special purpose graphics instructions. These special purpose graphics instructions concern the manipulation of data within the bit mapped portion of video RAM 132. Special graphic hardware 210 operates under the control of central processing unit 200 to enable particular advantageous data manipulations regarding the data within video RAM 132.

Memory interface 250 is coupled to major bus 205 and further coupled to video memory bus 122. Memory interface 250 serves to control the communication of data and instructions between graphics processor 120 and memory 130. Memory 130 includes both the bit mapped data to be displayed via video display 170 and instructions and data necessary for the control of the operation of graphics processor 120. These functions include control of the timing of memory access, and control of data and memory multiplexing. In the preferred embodiment, video memory bus 122 includes multiplexed address and data information. Memory interface 250 enables graphics processor 120 to provide the proper output on video memory bus 122 at the appropriate time for access to memory 130.

Graphics processor 120 lastly includes input/output registers 260 and video display controller 270. Input/output registers 260 are bidirectionally coupled to major bus 205 to enable reading and writing within these registers. Input/output registers 260 are preferably within the ordinary memory space of central processing unit 200. Input/output registers 260 include data which specifies the control parameters of video display controller 270. In accordance with the data stored within the input/output registers 260, video display controller 270 generates the signals on video control bus 124 for the desired control of digital to video converter 160. Data within input/output registers 260 includes data for specifying the number of pixels per horizontal line, the horizontal synchronization and blanking intervals, the number of horizontal lines per frame and the vertical synchronization blanking intervals. Input/output registers 260 may also include data which specifies the type of frame interlace and specifies other types of video control functions. Lastly, input/output registers 260 is a depository for other specific kinds of input and output parameters which will be more fully detailed below.

Graphics processor 120 operates in two differing address modes to address memory 130. These two address modes are X Y addressing and linear addressing. Because the graphics processor 120 operates on both bit mapped graphic data and upon conventional data and instructions, different portions of the memory 130 may be accessed most conveniently via differing addressing modes. Regardless of the particular addressing mode selected, memory interface 250 generates the proper physical address for the appropriate data to be accessed. In linear addressing, the start address of a field is formed of a single multibit linear address. The field size is determined by data within a status register within central processing unit 200. In X Y addressing the start address is a pair of X and Y coordinate values. The field size is equal to the size of a pixel, that is the number of bits required to specify the particular data at a particular pixel.

Figure 3:
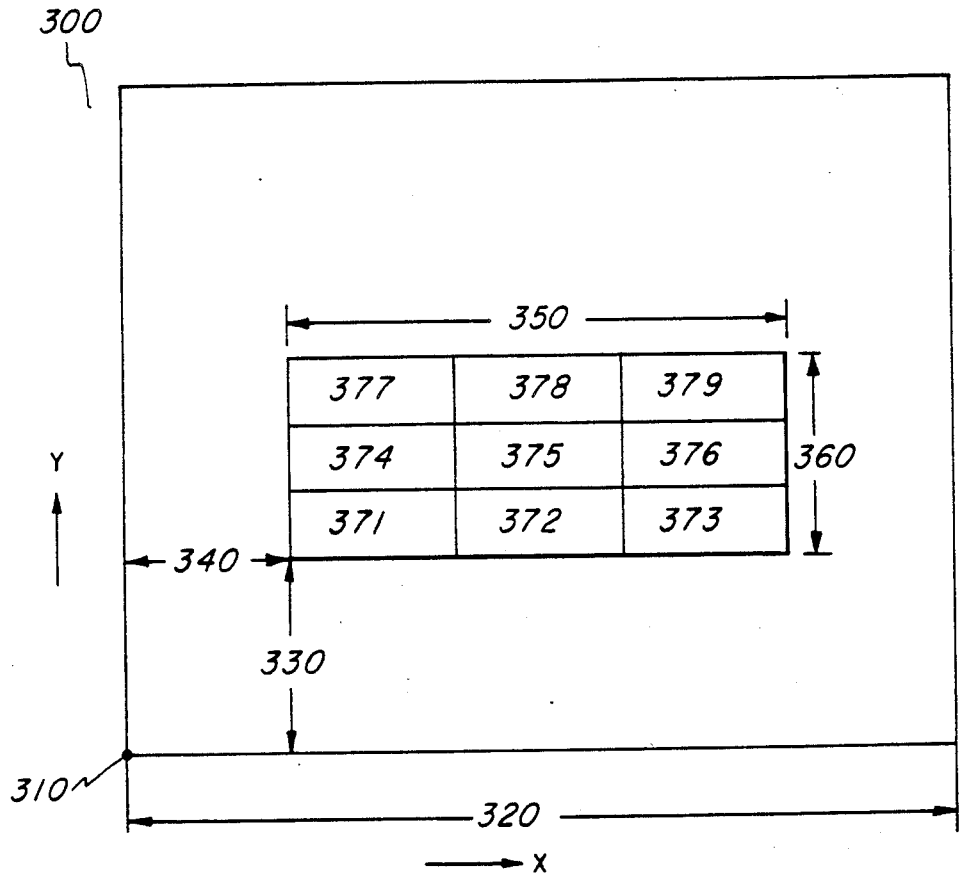
FIG. 3 illustrates the manner of specifying individual pixel addresses within the bit mapped memory in accordance with the X Y addressing technique.
Figure 4:
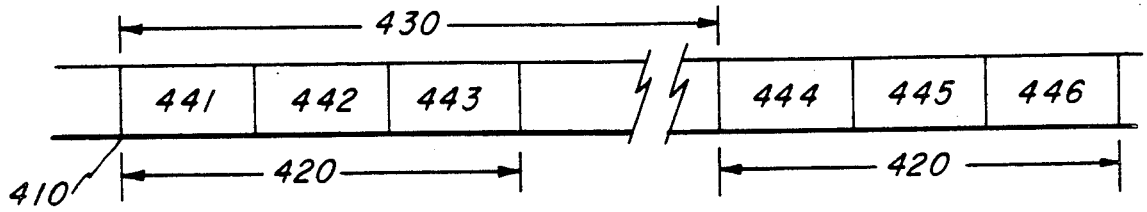
FIG. 4 illustrates a manner of specifying field addresses in accordance with the linear addressing technique.

FIG. 3 illustrates the arrangement of pixel data in accordance with an X Y addressing mode. Similarly, FIG. 4 illustrates the arrangement of similar data in accordance with the linear addressing mode. FIG. 3 shows origin 310 which serves as the reference point of the X Y matrix of pixels. The origin 310 is specified as a X Y start address and need not be the first address location within memory. The location of data corresponding to an array of pixels, such as a particular defined image element is specified in relation to the origin address 310. This includes an X start address 340 and a Y start address 330. Together with the origin, X start address 340 and Y start address 330 indicates the starting address of the first pixel data 371 of the particular image desired. The width of the image in pixels is indicated by a quantity delta X 350. The height of the image in pixels is indicated by a quantity delta Y 360. In the example illustrated in FIG. 3, the image includes nine pixels labeled 371 through 379. The last parameter necessary to specify the physical address for each of these pixels is the screen pitch 320 which indicates the width of the memory in number of bits. Specification of these parameters namely X starting address 340, Y starting address 330, delta X 350, delta Y 360 and screen pitch 320 enable memory interface 250 to provide the specified physical address based upon the specified X Y addressing technique.

FIG. 4 similarly illustrates the organization of memory in the linear format. A set of fields 441 to 446, which may be the same as pixels 371 through 376 illustrated in FIG. 3, is illustrated in FIG. 4. The following parameters are necessay to specify the particular elements in accordance with the linear addressing technique. Firstly, is the start address 410 which is the linear start address of the beginning of the first field 441 of the desired array. A second quantity delta X 420 indicates the length of a particular segment of fields in number of bits. A third quantity delta Y (not illustrated in FIG. 4) indicates the number of such segments within the particular array. Lastly, linear pitch 430 indicates the difference in linear start address between adjacent array segments. As in the case of X Y addressing, specification of these linear addressing parameters enables memory interface 250 to generate the proper physical address specified.

The two addressing modes are useful for differing purposes. The X Y addressing mode is most useful for that portion of video RAM 132 which includes the bit map data, called the screen memory which is the portion of memory which controls the display. The linear addressing mode is most useful for off screen memory such as for instructions and for image data which is not currently displayed. This latter category includes the various standard symbols such as alphanumeric type fonts and icons which are employed by the computer system. It is sometimes desirable to be able to convert an X Y address to a linear address. This conversion takes place in accordance with the following formula:

$$LA = \mathrm{OFF} + (Y \times SP + X) \times PS$$

Where: LA is the linear address; Off is the screen offset, the linear address of the origin of the X Y coordinate system; Y is the Y address; SP is the screen pitch in bits; X is the X address; and PS is the pixel size in bits. Regardless of which addressing mode is employed, memory 250 generated the proper physical address for access to memory 130.

Figure 5:
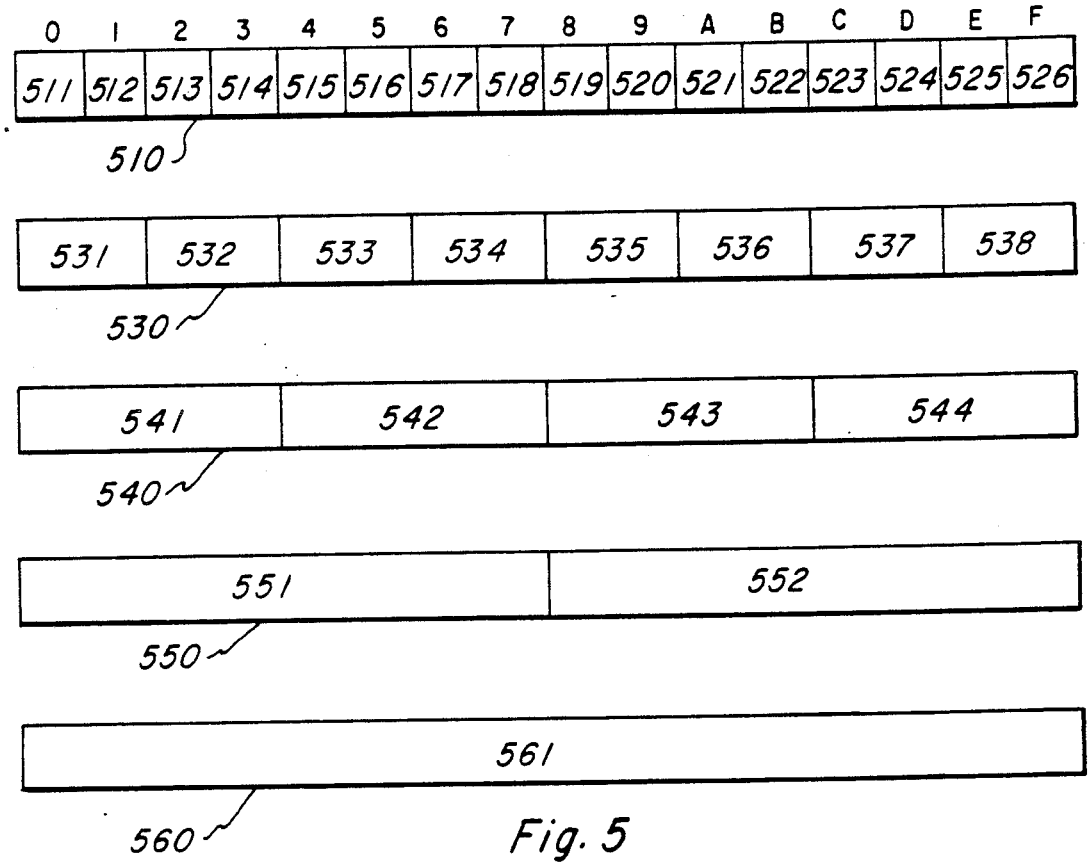
FIG. 5 illustrates the preferred embodiment of storage of pixel data of varying lengths within a single data word in accordance with the preferred embodiment of the present invention.

FIG. 5 illustrates the manner of pixel storage within data words of memory 130. In accordance with the preferred embodiment of the present invention, memory 130 consists of data words of 16 bits each. These 16 bits are illustrated schematically in FIG. 5 by the hexadecimal digits 0 through F. In accordance with the preferred embodiment of the present invention, the number of bits per pixel within memory 130 is an integral power of 2 but no more than 16 bits. As thus limited, each 16 bit word within memory 130 can contain an integral number of such pixels. FIG. 5 illustrates the five available pixel formats corresponding to pixel lengths of 1, 2, 4, 8 and 16 bits. Data word 510 illustrates 16 one bit pixels 511 to 526 thus 16 one bit pixels may be disposed within each 16 bit word. Data word 530 illustrates 8 two bit pixels 531 to 538 which are disposed within the 16 bit data word. Data word 540 illustrates 4 four bit pixels 541 to 544 within the 16 bit data word. Data word 550 illustrates 2 eight bit pixels 551 and 552 within the 16 bit word. Lastly, data word 560 illustrates a single 16 bit pixel 561 stored within the 16 bit data word. By providing pixels in this format, specifically each pixel having an integral power of two number of bits and aligned with the physical word boundaries, pixel manipulation via graphics processor 120 is enhanced. This is because processing each physical word manipulates an integral number of pixels. It is contemplated that within the portion of video RAM 132 which specifies the video display that a horizontal line of pixels is designated by a string of consecutive words such as illustrated in FIG. 5.

Figure 6:
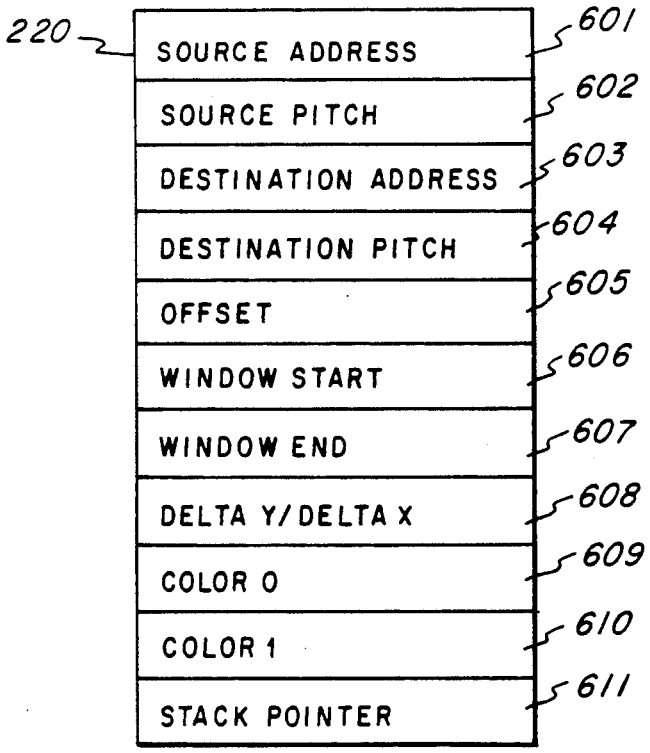
FIG. 6 illustrates the arrangement of contents of implied operands stored within the register memory in accordance with the preferred embodiment of the present invention.

FIG. 6 illustrates the contents of some portions of register files 220 which store implied operands for various graphics instructions. Each of the registers 601 through 611 illustrated in FIG. 6 are within the register address space of central processing unit 200 of graphics processor 120. Note, these register files illustrated in FIG. 6 are not intended to include all the possible registers within register files 220. On the contrary, a typical system will include numerous general purpose undesignated registers which can be employed by central processing unit 200 for a variety of program specified functions.

Register 601 stores the source address. This is the address of the lower left corner of the source array. This source address is the combination of X address 340 and Y address 330 in the X Y addressing mode or the linear start address 410 in the linear addressing mode.

Register 602 stores the source pitch or the difference in linear start addresses between adjacent rows of the source array. This is either screen pitch 340 illustrated in FIG. 3 or linear pitch 430 illustrated in FIG. 4 depending upon whether the X Y addressing format or the linear addressing format is employed.

Registers 603 and 604 are similar to registers 601 and 602, respectively, except that these registers include the destinations start address and the destination pitch. The destination address stored in register 603 is the address of the lower left hand corner of the destination array in either X Y addressing mode or linear addressing mode. Similarly, the destination pitch stored in register 604 is the difference in linear starting address of adjacent rows, that is either screen pitch 320 or linear pitch 430 dependent upon the addressing mode selected.

Register 605 stores the offset. The offset is the linear bit address corresponding to the origin of the coordinates of the X Y address scheme. As mentioned above, the origin 310 of the X Y address system does not necessarily belong to the physical starting address of the memory. The offset stored in register 605 is the linear start address of the origin 310 of this X Y coordinate system. This offset is employed to convert between linear and X Y addressing.

Registers 606 and 607 store addresses corresponding to a window within the screen memory. The window start stored in register 606 is the X Y address of the lower left hand corner of a display window. Similarly register 607 stores the window end which is the X Y address of the upper right hand corner of this display window. The addresses within these two registers are employed to determine the boundaries of the specified display window. In accordance with the well known graphics techniques, images within a window within the graphics display may differ from the images of the background. The window start and window end addresses contained in these registers are employed to designate the extent of the window in order to permit graphics processor 120 to determine whether a particular X Y address is inside or outside of the window.

Register 608 stores the delta Y/delta X data. This register is divided into two independent halves, the upper half (higher order bits) designating the height of the source array (delta Y) and the lower half (lower order bits) designating the width of the source array (delta X). The delta Y/delta X data stored in register 608 may be provided in either the X Y addressing format or in the linear addressing format depending upon the manner in which the source array is designated. The meaning of the two quantities delta X and delta Y are discussed above in conjunction with FIGS. 3 and 4.

Registers 609 and 610 each contain pixel data. Color 0 data stored in register 609 contains a pixel value replicated throughout the register corresponding to a first color designated color 0. Similarly, color 1 data stored in register 610 includes a pixel value replicated throughout the register corresponding to a second color value designated color 1. Certain of the graphics instructions of graphics processor 120 employ either or both of these color values within their data manipulation. The use of these registers will be explained further below.

Lastly, the register file 220 includes register 611 which stores the stack pointer address. The stack pointer address stored in register 611 specifies the bit address within video RAM 132 which is the top of the data stack. This value is adjusted as data is pushed onto the data stack or popped from the data stack. This stack pointer address thus serves to indicate the address of the last entered data in the data stack.

Figure 7:
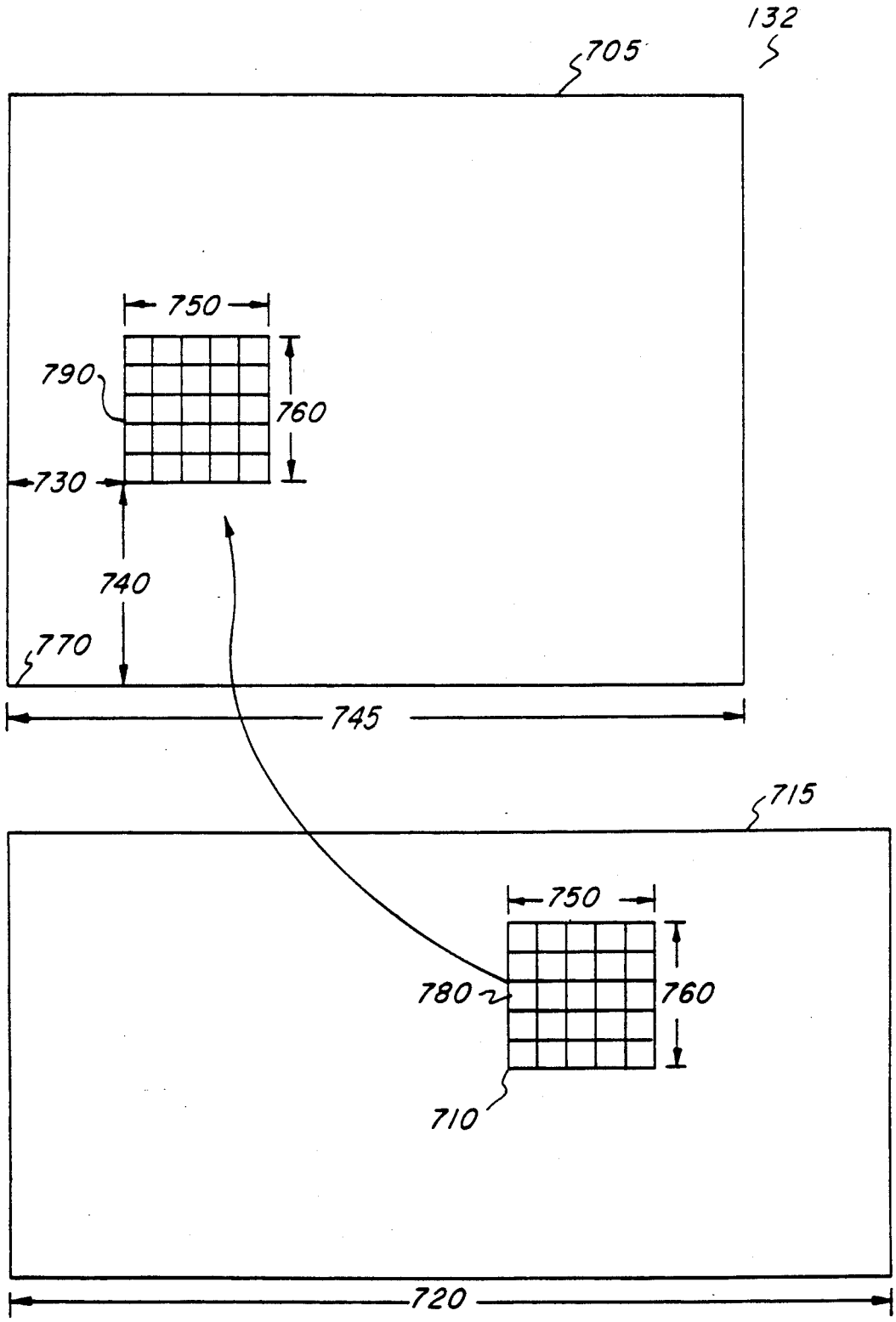
FIG. 7 illustrates the characteristics of an array move operation within the bit mapped memory of the present invention.

FIG. 7 illustrates in schematic form the process of an array move from off screen memory to screen memory. FIG. 7 illustrates video RAM 132 which includes screen memory 705 and off screen memory 715. In FIG. 7 an array of pixels 780 (or more precisely the data corresponding to an array of pixels) is transferred from off screen memory 715 to screen memory 705 becoming an array of pixels 790.

Prior to the performing the array move operation certain data must be stored in the designated resisters of register files 220. Register 601 must be loaded with the beginning address 710 of the source array of pixels. In the example illustrated in FIG. 7 this is designated in linear addressing mode. The source pitch 720 is stored in register 602. Register 603 is loaded with the destination address. In the example illustrated in FIG. 7 this is designated in X Y addressing mode including X address 730 and Y address 740. Register 604 has the destination pitch 745 stored therein. The linear address of the origin of the X Y coordinate system, offset address 770, is stored in register 605. Lastly, delta Y 750 and delta X 760 are stored in separate halves of register 608.

The array move operation illustrated schematically in FIG. 7 is executed in conjunction with the data stored in these registers of register file 220. In accordance with the preferred embodiment the number of bits per pixel is selected so that an integral number of pixels are stored in a single physical data word. By this choice, the graphics processor may transfer the array of pixels 780 to the array of pixels 790 largely by transfer of whole data words. Even with this selection of the number of bits per pixel in relation to the number of bits per physical data word, it is still necessary to deal with partial words at the array boundaries in some cases. However, this design choice serves to minimize the need to access and transfer partial data words.

In accordance with the preferred embodiment of the present invention the data transfer schematically represented by FIG. 7 is a special case of a number of differing data transformations. The pixel data from the corresponding address locations of the source image and the destination image are combined in a manner designated by the instruction. The combination of data may be a logical function (such as AND or OR) or it may be an arithmetic function (such as addition or subtraction). The new data thus stored in the array of pixels 790 is a function of both the data of the array of pixels 780 and the current data of pixels 790. The data transfer illustrated in FIG. 7 is only a special case of this more general data transformation in which the data finally stored in the destination array does not depend upon the data previously stored there.

Figure 8:
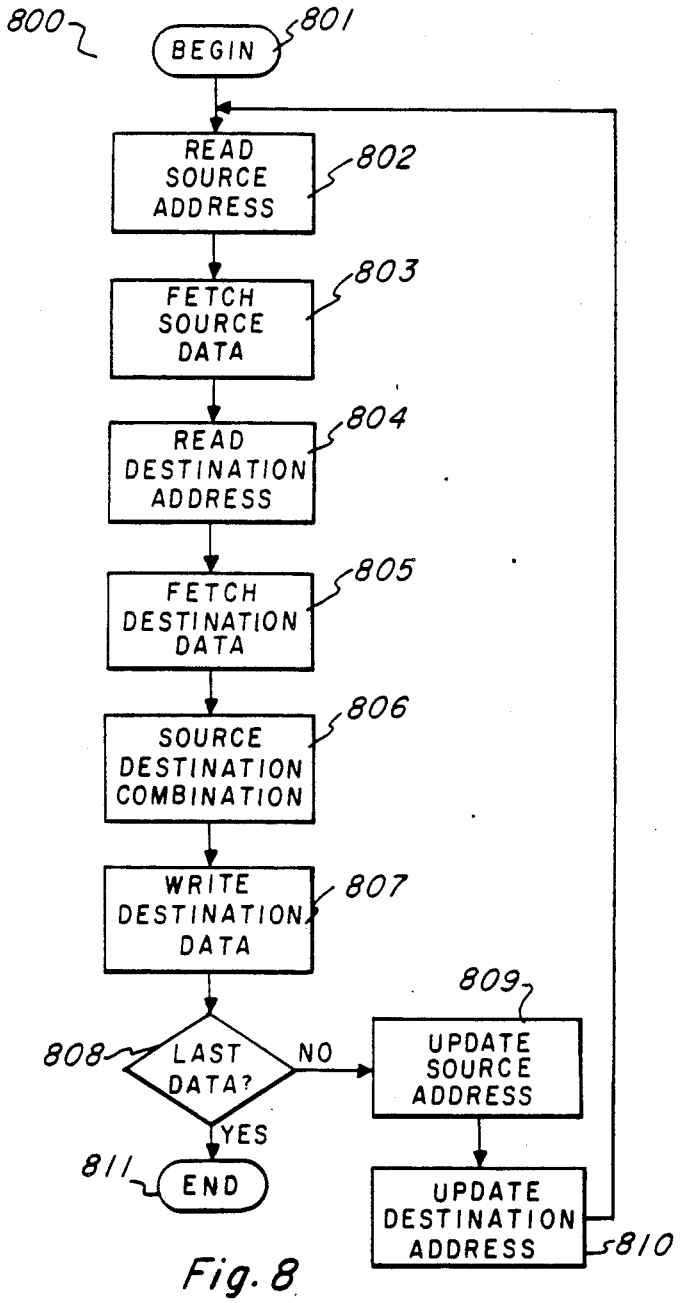
FIG. 8 illustrates a flow chart of a bit block transfer or array move operation in accordance with the present invention.

This process is illustrated by the flow chart in FIG. 8. In accordance with the preferred embodiment the transfer takes place sequentially by physical data words. Once the process begins (start block 801) the data stored in the register 601 is read to obtain the source address (processing block 802). Next graphics processor 120 fetches the indicated physical data word from memory 130 corresponding to the indicated source address (processing block 803). In the case that the source address is specified in the X Y format, this recall of data would include the steps of converting the X Y address into the corresponding physical address. A similar process of recall of the destination address from register 603 (processing block 804) and then fetching of the indicated physical data word (processing block 805) takes place for the data contained at the destination location.

This combined data is then restored in the destination location previously determined (processing block 806). The source and destination pixel data are then combined in accordance with the combination mode designated by the particular data transfer instruction being executed. This is performed on a pixel by pixel basis even if the physical data word includes data corresponding to more than one pixel. This combined data is then written into the specified destination location (processing block 807).

In conjunction with the delta Y/delta X information stored in register 608, graphics processor 120 determines whether or not the entire data transfer has taken place (decision block 808) by detecting whether the last data has been transferred. If the entire data transfer has not been performed, then the source address is updated. In conjunction with the source address previously stored in register 601 and the source pitch data stored in register 602 the source address stored in register 601 is updated to refer to the next data word to be transferred (processing block 809). Similarly, the destination address stored in register 603 is updated in conjunction with the destination pitch data stored in register 604 to refer to the next data word in the destination (processing block 810). This process is repeated using the new source stored in register 601 and the new destination data stored in register 603.

As noted above the delta Y/delta X data stored in register 608 is used to define the limits of the image to be transferred. When the entire image has been transferred as indicated with reference to the delta Y/delta X data stored in register 608 (decision block 808), then the instruction execution is complete (end block 811) and graphics processor 120 continues by executing the next instruction in its program. As noted, in the preferred embodiment this process illustrated in FIG. 8 is implemented in instruction microcode and the entire data transformation process, referred to as an array move, is performed in response to a single instruction to graphics processor 120.

Figure 9:
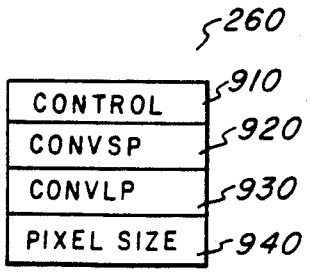
FIG. 9 illustrates the arrangement of contents of implied operands stored within the input/output registers in accordance with the preferred embodiment of the present invention.

FIG. 9 illustrates a portion of input/output registers 260 which is employed to store data relevant to the color expand operations of the present invention. Firstly, input/output registers 260 includes a register 910 which stores a control word. This control word is used to specify types of operations performed by central processing unit 210. In particular, several bits within the control words stored within register 910 specify the type of source destination combination performed during array moves. As noted in regards to FIG. 8 and in particular to processing block 806, this combination of source and pixel data may include various logic and arithmetic functions.

Registers 920 and 930 are employed to store data which is useful in converting between X Y and linear addresses. CONVSP data stored in register 920 is a precalculated factor employed to enable conversion from X Y addressing to linear addressing for screen pitch. This factor is:

$$16+\log_2 (\text{screen pitch})$$

In a similar fashion, the data CONVLP stored in register 930 is employed for conversion between X Y addressing and linear addressing for the linear pitch. This data corresponds to:

$$16+\log_2 (\text{linear pitch})$$

Storing this data in registers 920 and 930 in this manner enables central processing unit 200 to readily access this data in order to quickly implement the conversions between X Y addressing and linear addressing.

Register 940 has the pixel size data stored therein. The pixel size data indicates the number of bits per pixel within the displayable portion of video RAM 132. As previously noted in conjunction with FIG. 5, the pixel size is constrained by the preferred word size. In the preferred embodiment, graphics processor of the present invention operates on 16 bit data word. The number of bits per pixel is constrained in the preferred embodiment to be an integral factor of 16, the number of bits per word. Thus, the number of bits per word could be one, two, four, eight or sixteen. Register 940 stores pixel size data which equals the number of bits per word selected. Thus, if a single bit per word has been selected, register 940 stores the numerical data 1. Similarly, if two-bit per pixel has been selected, then register 940 stores numerical data equal to 2. Likewise, other possible numbers of bits per pixel are indicated by the numeric values stored within register 940. This pixel size data is employed by Central Processing Unit 200 in executing various instructions, in particular the color expand instruction to be discussed further below.

The execution of a color expand operation will now be described in conjunction with FIGS. 10 to 13. As noted above, it is advantageous in terms of required memory to store the type fonts for alphanumeric characters and other frequently used symbols such as icons in a monochrome format. This monochrome format will include a single bit per pixel, a "1" indicating a foreground pixel and a "0" indicating a background pixel. At the time any one of these arrays is to be displayed, it is moved from its off screen storage location into the portion of video RAM 132 which is displayed. In this operation, the single bit per pixel is expanded to become one of a pair of color codes. This pair of color codes corresponds to the color "0" data stored in register 609 and the color 1 data stored in register 610 of the register file. This transformation corresponds conceptually to the attachment of color to the figure at the time of drawing the figure on the screen, thus making these colors an attribute of the array move.

Figure 10:
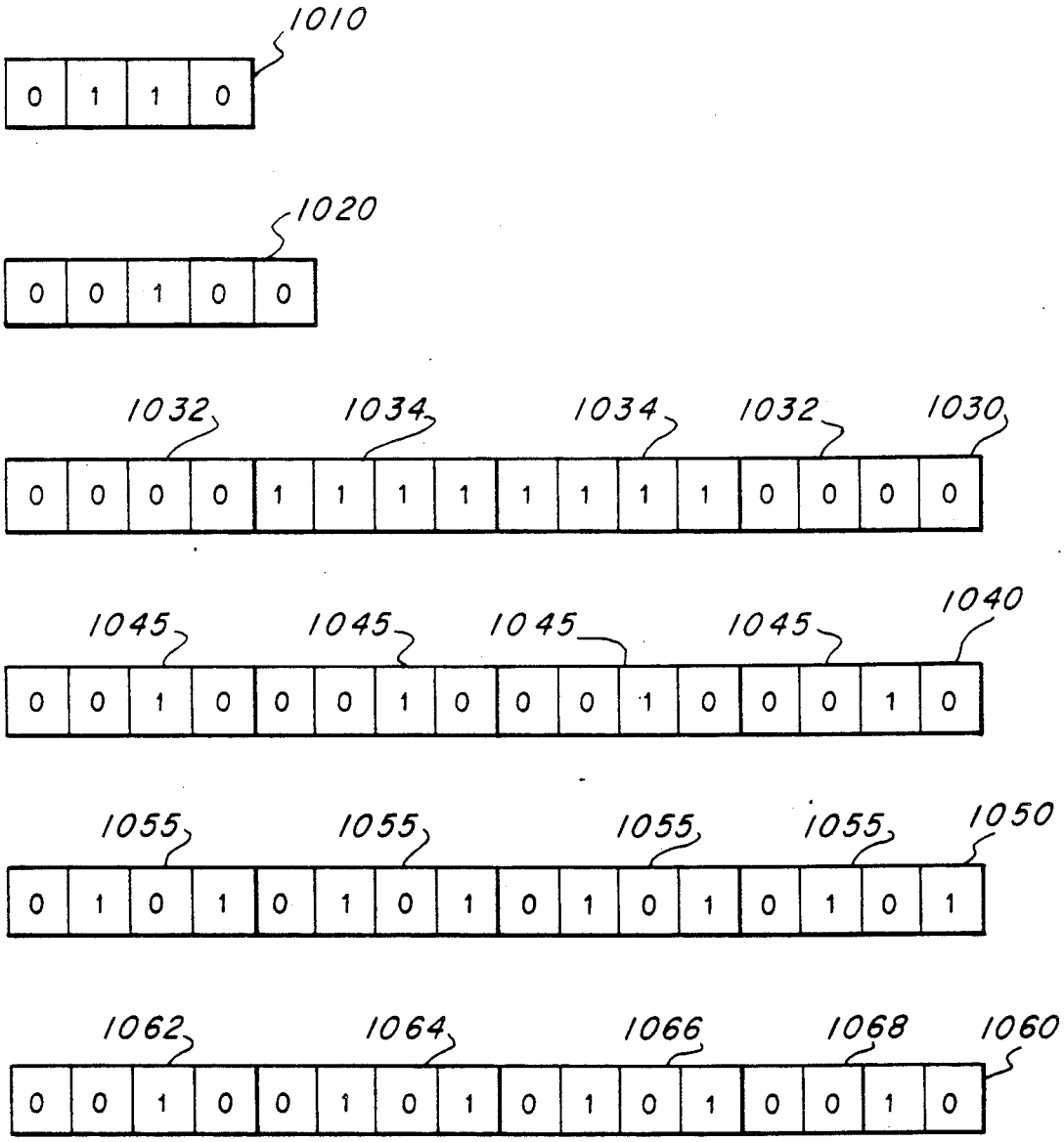
FIG. 10 illustrates schematically the color expand operation in accordance with the preferred embodiment of the present invention.

FIG. 10 illustrates an example of such a color expand operation for the case in which the pixel size is four bits. Four bits of monochrome data which are to be expanded into a single 16 bit word of color data are illustrated at 1010. These four bits of monochrome data correspond to four pixels. The pixel size data is illustrated at 1020. Note that the number indicated at 1020 is four, corresponding to four bits per pixel. While in general the color expand operation operates in conjunction with 16 bit data words in accordance with the preferred embodiment, only the four bits illustrated in 1010 are relevant because these four bits are sufficient to specify an entire 16 bit color word.

The color expand operation of the present invention is executed in two steps. In the first step, monochrome word 1010 is transformed into an expanded monochrome word 1030. Expanded monochrome word 1030 includes four pixels, because pixel size data 1020 indicates four bits per pixel and four of these pixels make an entire 16 bit word. Expanded monochrome data 1030 includes a pair of all "0" pixels 1032 and a pair of all "1" pixels 1034. These "0" and "1" pixels correspond to the arrangement of "0" and "1" pixels in monochrome data 1010. Note that expanded monochrome word 1030 is formed in conjunction with the number of bits per pixel indicated by pixel size data 1020. Therefore, for example, if pixel size data 1020 had indicated eight bits per pixel then they would only be two pixels within expanded monochrome word 1030.

Data 1040 corresponds to the color 0 data stored in register 609 of the register files and data 1050 corresponds to the color 1 data stored within register 610 of the register files. Note that color 1 data 1040 includes four bit color data 1045 replicated throughout this 16 bit word, and this example four times. Similarly, color 0 data 1050 includes four four-bit pixel values 1055. The color 0 and the color 1 pixel values are replicated throughout the 16 bit words because of the manner in which the expanded color is formed.

Data word 1060 illustrates the expanded data word in accordance with the present example. The expanded data word 1060 includes individual pixel data 1062, 1064, 1066 and 1068. The expanded color word 1060 is formed bit by bit by allowing the state of each bit within expanded monochrome data 1030 to determine whether the data from color 0 word 1040 or from color 1 word 1050 is applied to the expanded color word 1060. Note that pixel value 1062 corresponds to color 0 pixel value 1045 because all of the bits of the corresponding pixel value 132 are zero. The pixel data 1064 corresponds to the color 1 pixel value 1055 because all of the bits within pixel value 1034 of expanded monochrome word 1030 are ones. The expanded color output is formed bit by bit in order to enable this function to operate for differing pixel sizes.

Figure 11:
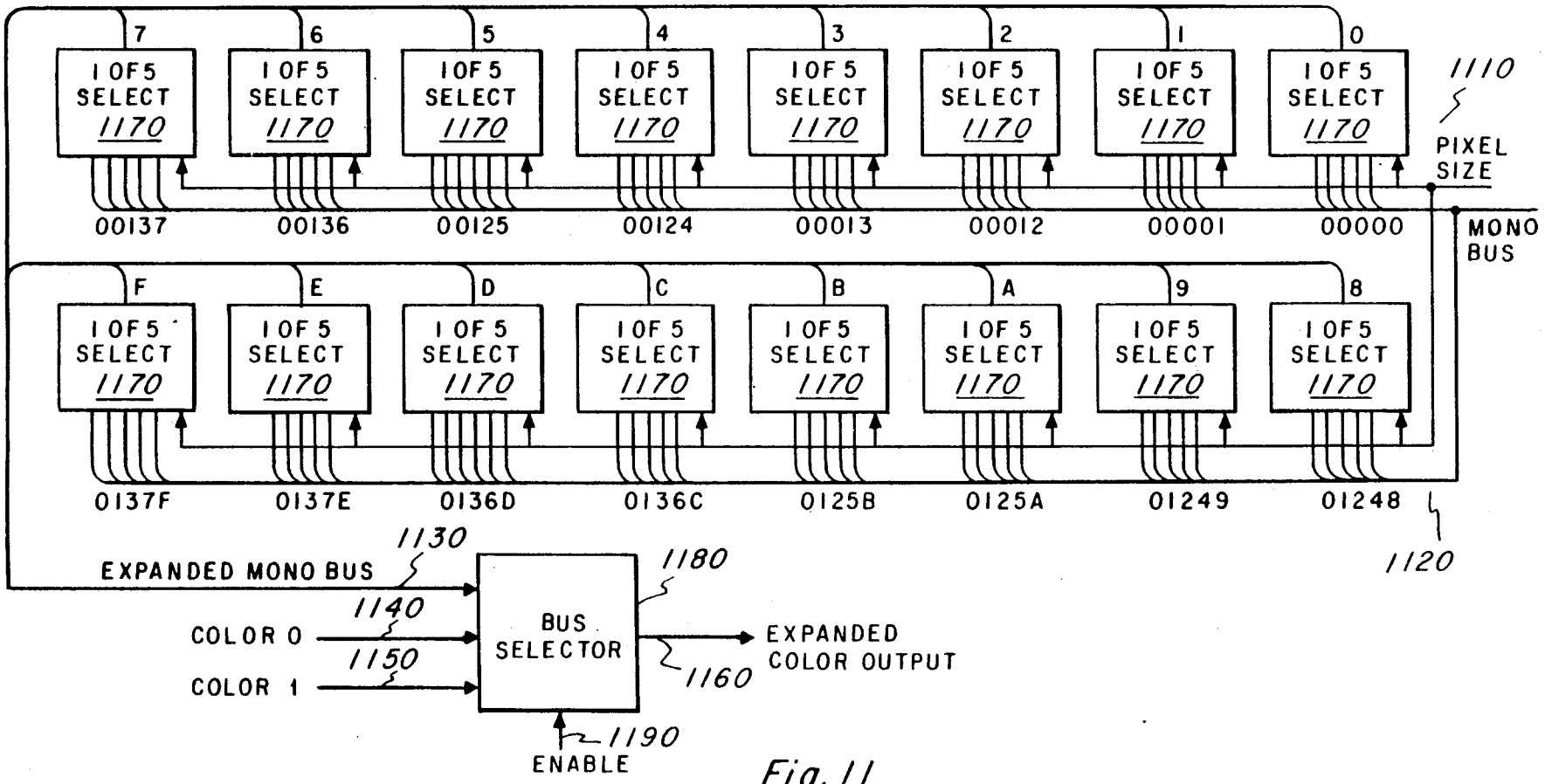
FIG. 11 illustrates the construction of the color expand circuit in accordance with the preferred embodiment of the present invention.

FIG. 11 illustrates color expand circuit 1100 which performs the color expand function. Color expand circuit 1100 is a part of special graphics hardware 210 within the graphics processor. Color expand circuit 1100, like other portions of special graphic hardware 210, is out of the control of central processing unit 200. Color expand circuit 1100 receives inputs from pixel size bus 1110, monochrome bus 1120, color 0 bus 1140, color 1 bus 1150 and enable signal 1190. Color expand circuit 1100 generates an expanded color output on bus 1160. Color expand circuit 1100 includes 16 one of five select circuits 1170 which receive data from the pixel size bus 1110 and monochrome bus 1120 and generates an expanded monochrome output on an expanded monochrome bus 1030. Color expand circuit 1100 further includes bus selector 1180 which receives the expanded monochrome bus 1130 the color 0 bus 1140, the color 1 bus 1150 and enable signal 1190 and generates the expanded color output on bus 1160.

Figure 12:
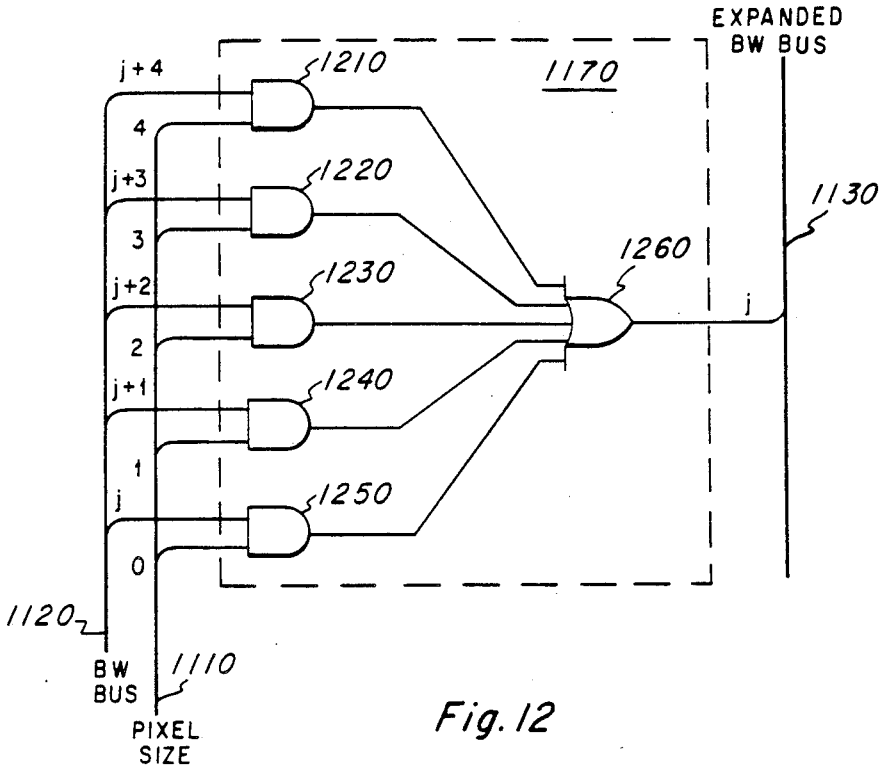
FIG. 12 illustrates the construction of the one of five select circuits shown in FIG. 11.

The signal applied to expanded monochrome bus 1130 is assembled bit by bit by 16 one of five select circuits 1170. Each of these 16 one of five select circuits 1170 has the five bits of the pixel size data 1110 applied thereto. Note that although input/output register 940 contains 16 bits in accordance with the preferred embodiment, only the five least significant bits are necessary to specify the pixel size. This is because the maximum pixel size in the preferred embodiment is 16 bits per pixel. In addition, each one of five select circuits 1170 has five of the 16 bits of monochrome bus 1120 applied thereto. A study of FIG. 11 indicates the bit numbers of the bits applied to each of the one of five circuits 1170. Referring briefly to FIG. 12, a detailed diagram of one of the one of five select circuits 1170 is illustrated. Each one of five select circuits 1170 includes five AND gates 1210, 1220, 1230, 1240 and 1250. Each of the AND circuits has a single bit from the pixel size bus 1110 applied thereto. In addition, each of these AND circuits has one bit of the five selected bits from the monochrome bus 1120 applied thereto. These are designated j, j+1, j+2, j+3 and j+4. Reference must be made to the numbers appearing in FIG. 11 to indicate which bits from monochrome bus 1110 are applied to each of the one of five select circuits 1170. The output of the five AND circuits 1210, 1220, 1230, 1240 and 1250 are applied to separate inputs of a single OR circuit 1260. This output becomes one of the bits of expanded monochrome bus 1130.

The operation of one of five select circuits 1170 will now be explained. One of five select circuit 1170 enables application of one of the five bits from monochrome bus 1120 to the expanded monochrome bus 1130. In accordance with the preferred embodiment, the only number of bits per pixel permitted are 1, 2, 4, 8 and 16. This is to ensure that an integral number of pixels is contained within each 16 bit data word. Since the pixel size data corresponds to the number of bits per pixel, only one of the bits zero through four of the pixel size bus 1110 contain a one no matter which pixel size is selected. All other bits are zero. Therefore, only one of the AND gates 1210, 1220, 1230, 1240 or 1250 is enabled, thereby permitting the selected bit from monochrome bus 1120 to be applied to OR gate 1260. Thus, OR gate 1260 receives zeros from all the nonselected AND gates and either a "0" or a "1" from the selected AND gate. This data is applied to the corresponding bit of the expanded monochrome bus 1130.

Referring back to FIG. 11, suppose for example that the number of bits per pixel selected was 16. Thus, each one of five select circuit 1170 selects the first of the bit numbers illustrated in FIG. 11. Thus, each of the 0 through F bits of expanded monochrome bus 1130 are selected from the 0 bit of the monochrome bus. If the number of bits per pixel is selected as eight, then each one of five select circuit 1170 selects the second bit of the monochrome bus 1120 applied thereto. Thus, bits 0 through 7 of expanded monochrome bus 1130 receive data from the 0 bit of the monochrome bus 1120 and bits 8 through F of the expanded monochrome bus 1130 receive data from the first bit of monochrome bus 1120. Similarly, if the pixel size is four, bits 0 to 3 receive data from the 0 bit of the monochrome bus 1120, bits 4 to 7 receive data from the 1 bit of monochrome bus 1120. Bits 8 to B receive data from the 2 bit of monochrome bus 1120 and bits C to F receive data from the third bit of monochrome bus 1120. Thus, depending upon the pixel size data, from 1, 2, 4, 8 or 16 bits of monochrome bus 1120 are selected to form expanded monochrome bus 1130.

Figure 13:
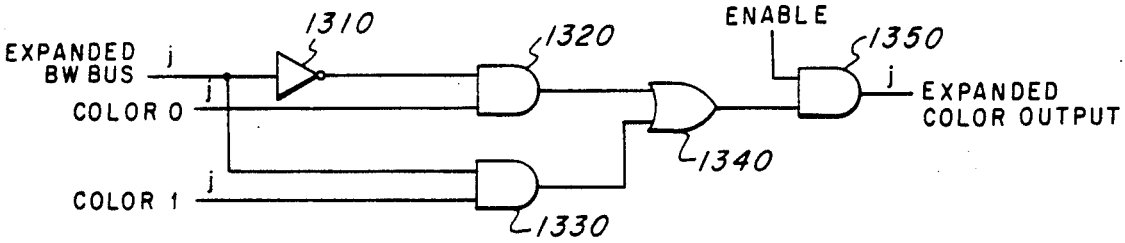
FIG. 13 illustrates the construction of a representative bit of the bus selector circuit shown if FIG. 11.

Bus selector 1180 enables selection of data from either color 0 bus 1140 or color 1 bus 1150 based upon the state of the corresponding bit of expanded monochrome bus 1130. An example of the j-th bit of bus selector 1180 is illustrated in FIG. 13. The j-th bit of the expanded monochrome bus is applied to inverter 1310 and one input of AND gate 1330. The output of inverter 1310 is applied to one input of another AND gate 1320. This arrangement insures that the signal on the j-th bit of the expanded monochrome bus enables one of the AND gates 1320 or 1330. The j-th bit of the color 0 bus is applied to the other input of AND gate 1320. Similarly, the j-th bit of the color 1 bus is applied to the other input of AND gate 1330. The outputs of the two AND gates 1120 and 1130 are applied to separate inputs of OR gate 1340. Dependent upon the state of the j-th bit of the expanded monochrome bus, the output of OR gate 1340 corresponds either to the j-th bit of color 0 or the j-th bit of color 1. This output is applied to one input and AND gate 1350. The other input of AND gate 1350 is the enable signal 1190. The output of AND gate 1350 is applied to the j-th bit of the expanded color output bus. Thus, this j-th bit of the expanded color output bus corresponds to the j-th bit of color 0 or the j-th bit of color 1 dependent upon the state of the j-th bit of the expanded monochrome bus, when enabled by enable signal 1190.

The described color expand circuit 1100 requires that the significant bits of the monochrome signal be shifted to the lower order bits within the monochrome bus 1120. Dependent upon the pixel size data and pixel size 1110, data from the least significant, the two least significant, the four least significant, the eight least significant or the entire data word is employed to generate the signal on expanded monochrome bus 1130. In order to provide a color expand function for further bits within this monochrome word, the data must be right shifted a number of bits corresponding to the pixel size data. Then the next unused monochrome data is applied to color expand circuit 1100 to generate an expanded color output corresponding to the next pixels.

Although the present invention has been described in conjunction with 16 bit data words, those skilled in the art understand that this limitation is merely a matter of convenience. Other larger or smaller number of bits per data word is possible utilizing the principles of the present invention.

We claim:

1. A color image processing apparatus comprising:

a memory means for storing an image arranged in a first array of pixels, each pixel represented by a code having a plurality of bits, and for storing an image arranged in a second array of pixels, each pixel represented by a bit having a value of "1" or "0"; and a color expand unit connected to said memory means, for storing in said first array an image corresponding to an image stored in said second array, each pixel of said image in said first array corresponding to a pixel of said image in said second array, wherein said color expand unit stores a first color code in said pixel of said first array if said corresponding pixel of said second array is represented by a "1", and stores a second color code if said corresponding pixel of said second array is represented by a "0", said color expand unit operating on plural pixels in parallel.

2. A color image processing apparatus as claimed in claim 1, further comprising:

a visually display means connected to said memory means for generating a visually perceivable representation of said image stored in said first array of pixels of said memory means, each pixel having a color corresponding to said representative color code.

3. A color image processing apparatus as claimed in claim 1, further comprising:

a first color register for storing therein said first color code;

a second color register for storing therein said second color code.

4. A color image processing apparatus as claimed in claim 3, further comprising:

color selection means connected to said first and second color registers for storing said first color code in said first color register and said second color code in said second color register.

5. A color image processing apparatus as claimed in claim 11, further comprising:

a source indicating means for indicating the location of said second array within said memory means where said image is stored; and a destination indicating means for indicating the location of said first array within said memory means where said image is to be stored.

6. A color image processing apparatus as claimed in claim 5, wherein:

said source indicating means includes a source address register for storing the address of said image in said second array, and a size register for storing a value corresponding to the size of said image in said second array; and said destination indicating means includes a destination address register for storing the address of said image in said first array.

7. A color image processing apparatus as claimed in claim 6, wherein:

said size register includes an width section storing data indicative of the horizontal size of said image in said second array and a height section storing data indicative of the vertical size of said image in said second array.

8. A color image processing apparatus as claimed in claim 1, wherein:

said image stored in said second array comprises a plurality of monochrome images corresponding to alphanumeric characters.

9. A color image processing apparatus as claimed in claim 1, wherein:

said image stored in said second array comprises a plurality of sets of of alphanumeric characters, each of said sets corresponding to a font.

10. A color image processing apparatus as claimed in claim 1, wherein:

said image stored in said second array comprises a plurality of monochrome images corresponding to icons.

11. A digital data processing apparatus comprising:

a pixel size register for storing a value corresponding to a number N;

a first color bus having M data lines, M being an integral multiple of N, said first color bus for transmitting M/N pixels represented by an N bit first color code;

a second color bus having M data lines, said second color bus for transmitting M/N pixels represented by an N bit second color code;

a monochrome image bus having M/N data lines, for transmitting image data;

an expanded monochrome image bus having M data lines;

an expansion means connected to said pixel size register, said monochrome image bus and said expanded monochrome image bus for generating an expanded monochrome image on said expanded monochrome image bus, said expanded monochrome image represented on said expanded monochrome image bus by a group of N "1" bits corresponding to a "1" bit on said monochrome image bus and by a group of N "0" bits corresponding to a "0" bit on said monochrome image bus;

an output image bus having M data lines; and a color code substitution means connected to said first and second color buses, said expanded monochrome image bus and said output image bus for generating an output image on said output image bus, said output image represented by said first N bit color code corresponding to a group of N "1" bits on said expanded monochrome image bus and by said second N bit color code corresponding to a group of N "0" bits on said expanded monochrome image bus.

12. A graphics data processing apparatus as claimed in claim 11, further comprising:

a first color register connected to said first color bus for storing said N bit first color code; and a second color register connected to said second color bus for storing said N bit second color code.

13. A graphics data processing apparatus as claimed in claim 11, further comprising:

a monochrome image memory connected to said monochrome image bus for storing said monochrome image; and a display memory connected to said output image bus for storing said output image.

14. A graphics data processing apparatus as claimed in claim 11, further comprising:

a memory means connected to said monochrome image bus and said output image bus including a data portion having at least one monochrome image stored therein, and including a display portion for storing in a subset thereof said output image;

a source indicating means for indicating the locations within said memory means where said at least one monochrome image is stored; and a destination indicating means for indicating the locations within said memory means where said output image is to be stored.

15. A color image processing apparatus comprising:

a memory means for storing an image arranged in a first array of pixels, each pixel represented by a digital code having a plurality of bits, and for storing an image arranged in a second array of pixels, each pixel represented by a bit having a value of "1" or "0";

a color expand unit connected to said memory means for storing in said first array an expanded image corresponding to an image stored in said second array of said memory means, each pixel of said expanded image corresponding to a pixel of said image in said second array, each pixel of said expanded image represented by a first digital code if said corresponding pixel of said image in said second array is represented by a "1" and represented by a second digital code if said corresponding pixel of said image in said second array is represented by a "0", said color expand unit operating on plural pixels in parallel; and an array operation means connected to said color expand means and said memory means for storing, in a selected subset of said memory means, a combined image, each pixel of said combined image being a digital code which, for each pixel in said selected subset of said memory means, is a combination of digital code of a pixel in said expanded image and the contents of said pixel in said selected subset of said memory means.

16. A color image processing apparatus as claimed in claim 15, further comprising:

a visual display means connected to of said memory means for generating a visually perceivable representation of the image stored by said second array of pixels, each pixle having a color corresponding to its digital code.

17. A color image processing apparatus as claimed in claim 15, further comprising:

a first color register connected to said color expand means for storing therein said first digital code; and a second color register connected to said color expand means for storing therein said second digital code.

18. A color image processing apparatus as claimed in claim 15, further comprising:

a source indicating means for indicating the locations within said memory means where said image in said first array is stored; and a destination indicating means for indicating the locations within said selected subset of said memory means into which said combined image is to be stored.

19. A color image processing apparatus as claimed in claim 15, wherein:

said array operation means comprises a central processing unit for performing a logical combination of the individual bits of said digital code of a pixel of said expanded image and the contents of a pixel in said selected subset of said memory means.

20. A color image processing apparatus as claimed in claim 19, wherein:

said logical combination of bits is an AND function.

21. A color image processing apparatus as claimed in claim 19, wherein:

said logical combination of bits is an OR function.

22. A color image processing apparatus as claimed in claim 15, wherein:

said array operation means comprises a central processing unit for performing an arithmetic combination of the numbers represented by said digital code of a pixel of said expanded image and the contents of a pixel in said selected subset of said display memory.

23. A color image processing apparatus as claimed in claim 22, wherein:

said arithmetic combination of represented numbers is an addition.

24. A coloer image processing apparatus as claimed in claim 22, wherein:

said arithmetic combination of represented numbers is an subtraction.

25. A data processing apparatus, comprising:

a memory interface for communication of address and data information to an external image memory;

a color processing unit, connected to said memory interface, for receiving from said memory interface an input data word representing a plurality of pixels of an image stored in said image memory, each of said pixels represented by a bit of said input data word, and for presenting to said memory interface, for writing into said external image memory, an input data word representing each of said pixels represented by said input data word, said output data word representing each pixel, with a first digital code responsive to its corresponding input data word bit being a "0" state, and with a second digital code responsive to its corresponding input data word bit being a "1" state, said color processing unit operating on plural pixels in parallel.

26. The data processing apparatus of claim 25, wherein said color processing unit comprises:

a first color register for storing said first digital code;

a second color register for storing said second digital code;

input means, connected to said memory interface, for receiving said input data word; and a selector for communicating either the contents of said first color register or said second color register to said memory interface, responsive to the value of the bits in said input data word, said selected contents comprising said output data word.

27. The data processing apparatus of claim 26, wherein said color processing unit further comprises:

a pixel size register, for storing a value corresponding to the number of bits in the first and second digital codes; and input data word expand means, connected to said input means, for communicating to said selector an expanded input data word, said expanded input data word having, for each bit of said input data word, a plurality of bits having the same data state as said bit of said data word, said plurality of bits for each bit numbering the same as the number of bits in the first and second digital codes.

28. The data processing apparatus of claim 27, wherein said selector comprises:

a multiplexer for each bit of said output data word, said multiplexer receiving the contents of a bit of said first color register, the corresponding bit of said second color register, and the corresponding bit of said expanded input data word, said multiplexer presenting at its ouput the contents of said bit of said first color register responsive to said corresponding bit of said expanded input data word being at a "0" state, and presenting at its output the contents of said bit of said second color register responsive to said corresponding bit of said expanded input data word being at a "1" state.

29. A method of expanding monochrome image data stored in a first memory portion into color image data stored in a second memory portion including the steps of: reading an input data word of plural bits, with each bit having one of a first and second state, from said first memory portion wherein each said input bit represents a predetermined pixel of said monochrome image data; selecting a first multi-bit digital code if each said input bit is in said first state and selecting a second multi-bit digital code if each said input bit is in said second state, said selecting first and second multi-bit digital codes including operating on plural pixels in parallel; and writing said selected multi-bit digital codes to said second memory portion wherein said written multi-bit digital codes represent pixels of said color image data.

30. A method of expanding monochrome image data into color image data stored in a memory including the steps of: receiving an input data word having a plurality of bits wherein each said bit represents a pixel of said monochrome image data; expanding in parallel each said bit into a corresponding digital code representing color image data in response to the state of each said bit; and writing each said corresponding digital code to said memory.

31. A graphics computer system comprising:

a. a host processing system including at least one processor, read only memory, random access memory and assorted peripheral devices for forming a complete computer system, said host processing system furnishing host data determining the content of a visual image to be presented;

b. graphics memory circuits including video random access memory, said video random access memory being capable of storing bit mapped display data signals representing said visual image and being capable of storing said host data, said graphics memory circuits also being capable of storing instruction signals used for processing said host data and said display data;

c. video display circuits connected to said video random access memory, said video display circuits being capable of forming said visual image in response to receipt of said display data from said graphics memory circuits; and d. graphics processor circuits including:

i. central processing unit circuits capable of performing general purpose data processing, including a number of arithmetic and logic operations normally included in a general purpose processing unit, by executing said instructions accessed from said graphics memory circuits, said central processing unit circuits processing at least said host data to produce said display data in response to executing said instructions; and ii. special graphics hardware circuits connected to said central processing unit circuits and operating in conjunction with and under control of said central processing unit circuits to process at least said host data in producing said display data, said special graphics hardware circuits including color expansion circuits operating on plural pixels in parallel to convert a monochrome word of plural pixels, with each pixel represented by one bit, to an expanded color word of plural pixels, with each pixel represented by plural bits, each one bit pixel in said monochrome word determining a plural bit color code in said expanded color word.

32. A graphics computer system comprising:

a. graphics memory circuits including video random access memory, said video random access memory being capable of storing bit mapped display data signals representing said visual image and being capable of storing source data, said graphics memory circuits being capable of storing instruction signals used for processing said source data and said display data;

b. video display circuits connected to said video random access memory, said video display circuits being capable of forming said visual image in response to receipt of said display data; and c. graphics processor circuits including:

i. central processing unit circuits capable of performing general purpose data processing, including a number of arithmetic and logic operations normally included in a general purpose processing unit, by executing said instructions accessed from said graphics memory circuits, said central processing unit circuits processing at least said source data to produce said display data in response to executing said instructions; and ii. special graphics hardware circuits connected to said central processing unit circuits and operating in conjunction with and under control of said central processing unit circuits to process at least said host data in producing said display data, said special graphics hardware circuits including color expansion circuits processing plural pixels in parallel to convert a monochrome word of plural pixels, with each pixel represented by one bit, to an expanded color word of plural pixels, with each pixel represented by plural bits, each one bit pixel in said monochrome word determining a plural bit color code in said expanded color word.

33. A graphics system arrangement comprising:

a. host processing system terminals adapted for connection to a host processing system that determines the content of a visual display to be presented to a user by supplying host data;

b. graphics memory circuits including video random access memory, said video random access memory being capable of storing bit mapped display data signals representing said visual image and being capable of storing said host data, said graphics memory circuits being capable of storing instruction signals used for processing said host data and said display data;

c. graphics processor circuits connected to said host processing system terminals and said graphics memory circuits, said graphics processor circuits operating to transfer host data received at said host terminals to said graphics memory circuits and to process said host data and display data in response to said instruction signals stored in said graphics memory circuits, said graphics processor circuits including special graphics hardware circuits operating in conjunction with and under control of said graphics processor circuits to process at least said host data in producing said display data, said special graphics hardware circuits including color expansion circuits operating on plural pixels in parallel to convert a monochrome word of plural pixels, with each pixel represented by one bit, to an expanded color word of plural pixels, with each pixel represented by plural bits, each one bit pixel in said monochrome word determining a plural bit color code in said expanded color word;

d. video palette circuits coupled to said graphics memory circuits and operating to convert said bit mapped display data signals from said graphics memory circuits to video level output signals;

e. video connector terminals adapted for connection to a video display that presents a visual image to a user in response to received video image signals; and f. converter circuits connected to said video palette signals and said video connector terminals for converting said video level output signals to video image signals at said video connector terminals.

34. A display system comprising:

a. a display generating a visual image for presentation to a user in response to receiving display data signals;

b. memory circuits capable of storing host data and said display data and capable of storing instruction signals used for processing said host data and said display data, said memory circuits producing said display data signals from said display data;

c. processor circuits including:

i. central processing unit circuits capable of performing general purpose data processing, including a number of arithmetic and logic operations normally included in a general purpose processing unit, by executing said instructions accessed from said graphics memory circuits, said central processing unit circuits processing at least said host data to produce said display data in response to executing said instructions; and ii. special hardware circuits operating in conjunction with said central processing unit circuits to effect particular manipulations of said host data and said display data, said special hardware circuits including color expansion circuits operating on plural pixels in parallel to convert host data in the form of a monochrome word of plural pixels, with each pixel represented by one bit, to display data in the form of an expanded color word of plural pixels, with each pixel represented by plural bits, each one bit pixel in said monochrome word determining a plural bit color code in said expanded color word; and d. a host system determining the content of said visual image by causing said host data to be placed in said memory circuits.

35. A graphics processor comprising:

a. host interface circuits adapted to control communication with a host processing system furnishing host data;

b. memory interface circuits adapted to control communication of data and instructions with a memory capable of storing display data and said instructions and said host data;

c. central processing unit circuits connected between said host interface circuits and said memory interface circuits, said central processing unit circuits being capable of performing general purpose data processing including a number of arithmetic and logic operations normally performed in a general purpose processing unit in response to executing said stored instructions, said central processing unit circuits processing at least said host data to produce said display data in response to executing said instructions; and d. special graphics hardware circuits connected to said central processing unit circuits and operating in conjunction with and under control of said central processing unit circuits to process at least said host data in producing said display data, said special graphics hardware circuits including color expansion circuits operating on plural pixels in parallel to convert a monochrome word of plural pixels, with each pixel represented by one bit, to an expanded color word of plural pixels, with each pixel represented by plural bits, each one bit pixel in said monochrome word determining a plural bit color code in said expanded color word.

36. A graphics display system comprising:

processor circuits processing bit mapped display data to control the content of a user viewable display, said processor including a color expand unit processing plural pixels in parallel to convert a monochrome word of plural pixels, with each pixel represented by one bit, to an expanded color word of plural pixels, with each pixel represented by plural bits, each one bit pixel in said monochrome word determining a plural bit color code in said expanded color word; and memory circuits connected to said processor and storing said bit mapped display data, including said expanded color words, processed by said processor, said memory device including a multi-bit serial output adapted to be connected to said user viewable display.

37. The structures of claims 31, 32, 33, 34, 35 or 36 in which said color expansion circuits include plural one of N select circuits that receive said monochrome word of bits and produce an expanded monochrome word of bits.

38. The structure of claim 37 including a pixel size register containing a single bit in one of plural locations indicating the number of bits representing a pixel in said expanded color word, said register supplying said single bit in a desired one of plural locations to said one of N select circuits.

39. The structure of claim 37 in which there is one of said one of N select circuits for each bit in said expanded monochrome word of bits.

40. The structure of claim 37 in which each of said one of N select circuits furnishes only two stages of gating.

41. The structure of claim 39 in which each of said one of N select circuits receive only selected ones of said bits of said monochrome word.

42. The structure of claim 37 in which said color expansion circuits include bus selector circuits that receive said expanded monochrome word of bits and produce said expanded color word.

43. The structure of claim 42 in which there is one of said bus selector circuits for each bit of said expanded monochrome bits.

44. The structure of claim 42 including two color registers each containing a plural number of bits representing a desired color in said expanded color word, both of said color registers supplying their respective plural number of bits to said bus selector circuits.

45. The structure of claim 37 in which a monochrome bit of one sense represents a foreground symbol and a monochrome bit of another sense represents background.

46. The structures of claims 31, 32, 33, 34, 35 or 36 in which said color expansion circuits include an enable lead receiving an enable signal to enable said conversion to said expanded color word.

47. A method of processing data comprising:

a. reading an input word having plural bits of binary information representing monochrome symbol data with each bit representing one pixel;

b. determining a number of expanded bits with which to represent each pixel;

c. expanding each bit of said monochrome input word to said number of expanded bits, with all of said expanded bits for each pixel being of the same binary sense;

d. forming an expanded color word by replacing all the bits representing each pixel with at least one color code of bits depending on the binary sense of said bits of said expanded monochrome input word; and e. writing said expanded color word to a desired location.

48. A method of processing data comprising:

a. reading an input word of plural pixels, each input word having plural bits of binary information representing monochrome symbol data with each bit representing one pixel;

b. transforming said input word into an expanded monochrome word of plural pixels having plural bits representing each pixel, with each bit of said input word being transformed into plural bits, in said expanded monochrome word, of the same sense as said input word bit;

c. converting the plural bits representing each pixel in said monochrome word into at least one color code depending upon the sense of said plural bits representing said pixel to form an expanded color word; and d. writing said expanded color word to a desired location.

49. The method of claim 48 in which said converting occurs by separately converting each bit of said expanded monochrome word into said expanded color word.

50. The method of claim 49 in which said transforming transforms each bit of said input word into a certain number of bits in the expanded monochrome word depending upon the number of bits representing a pixel, and said certain number changes for different numbers of pixels in each expanded monochrome word.

* * * * *